US005196814A

United States Patent [19]

Felker et al.

[11] Patent Number: 5,196,814

[45] Date of Patent: Mar. 23, 1993

[54] HIGH POWER, HIGH FREQUENCY, VACUUM FLANGE

[75] Inventors: Brian Felker, Livermore; Michael R. McDaniel, Manteca, both of Calif.

[73] Assignee: The United States of America as represented by the United States Department of Energy, Washington, D.C.

[21] Appl. No.: 786,647

[22] Filed: Nov. 1, 1991

[51] Int. Cl.[5] ..... H01P 1/04

[52] U.S. Cl. ..... 333/254; 285/336; 285/917

[58] Field of Search ..... 333/239, 254–257; 285/336, 363, 917; 277/236

[56] References Cited

U.S. PATENT DOCUMENTS

| | | | |
|---|---|---|---|
| 3,208,758 | 9/1965 | Carlson et al. | 285/336 X |
| 3,322,444 | 5/1967 | Sewell et al. | 333/254 X |
| 3,368,818 | 2/1968 | Asamaki et al. | 285/363 X |
| 4,845,448 | 7/1989 | Olsson | 333/254 |
| 5,129,657 | 7/1992 | McManigal | 285/917 X |
| 5,135,269 | 8/1992 | Babuder | 285/917 X |

*Primary Examiner*—Paul Gensler

*Attorney, Agent, or Firm*—Henry P. Sartorio; Roger S. Gaither; William R. Moser

[57] ABSTRACT

An improved waveguide flange is disclosed for high power operation that helps prevent arcs from being initiated at the junctions between waveguide sections. The flanges at the end of the waveguide sections have counterbores surrounding the waveguide tubes. When the sections are bolted together the counterbores form a groove that holds a fully annealed copper gasket. Each counterbore has a beveled step that is specially configured to insure the gasket forms a metal-to-metal vacuum seal without gaps or sharp edges. The resultant inner surface of the waveguide is smooth across the junctions between waveguide sections, and arcing is prevented.

13 Claims, 2 Drawing Sheets

HIGH POWER, HIGH FREQUENCY, VACUUM FLANGE

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention relates to waveguides. In particular, the present invention relates to improving the quality of the inner surface of waveguides.

Today's waveguides are required to carry electromagnetic radiation at higher frequencies with higher power levels than ever before. Gyrotrons can currently power 3½" diameter circular waveguides with 500 kW of power at 140 Ghz, with further increases seen in the future. Earlier 2½" diameter waveguides can carry 200 kW at 35 kW at 250 GHz, but they cannot achieve today's power and frequency levels simultaneously. Electrical arcing is a crucial limiting factor in the ability to increase the power and frequency levels carried by waveguides.

Anything that causes electrical arcs to form inside a waveguide must be avoided because they travel backwards up the waveguide to the power source. An arc can seriously damage or destroy an expensive piece of equipment such as a gyrotron. In general, an arc will be initiated by a high field concentration around discontinuities, and will then be perpetuated by the electromagnetic field inside the waveguide.

A combination of factors can contribute to arc formation inside of a waveguide. Roughness, gaps, or debris on the waveguide surface, as well as increasing the power, frequency, or duration of the microwave pulse—all of these may result in arcing. Recent trends towards increasing the power, frequency, and pulse duration of the microwaves carried inside a waveguide have therefore necessitated smoother and cleaner waveguide walls.

Inasmuch as waveguides are put together in sections, there is a need to form a smooth transition across the border from one section to another. Additionally, a vacuum seal must be maintained at the junction between sections.

In the past, the flanges at the ends of waveguide sections have been fitted with a counterbore around their inner periphery. When the flanges from adjoining waveguide sections are bolted together a groove around the inside diameter of the waveguide is formed from the counterbores. A circular annealed copper gasket fits into the groove that is supposed to provide vacuum sealing and surface continuity. The prior art groove is provided with two circular, opposing steps having rectangular cross sections that press against the sides of the gasket when the flanges are bolted together to insure a tight vacuum seal. Such an arrangement is described for a rectangular waveguide in U.S. Pat. No. 3,201,725 to Johnson, dated Aug. 17, 1965, and assigned to Varian. Similar arrangements have been used more recently with circular waveguides—these flanges are called Shively Flanges and are also associated with Varian. It was previously thought that the Shively Flange type of seal was metal-to-metal, and that the gasket itself was flush with the waveguide wall.

In fact, it has been found that this type of seal is not altogether satisfactory. Small gaps between the gasket and the walls of the groove are formed with this arrangement, and the gasket was found to have sharp edges protruding slightly into the waveguide interior. Apparently, the undesirable gaps and edges are the result of the way the gasket is deformed by the pressure from the opposing steps in the groove.

Therefore, to handle the increasing drive requirements of waveguides there is a demand for an improved seal having a configuration that eliminates all sharp edges and gaps across the boundary between waveguide sections.

SUMMARY OF THE INVENTION

It is an object of the present invention to provide an improved vacuum and radio frequency seal that insures a smooth metal-to-metal transition across waveguide sections without gaps or sharp edges.

It is a further object of the invention to provide a seal with a simple configuration that is inexpensive and may be easily machined.

It is still an additional object of the invention to provide a seal that will enable a waveguide to be driven at higher powers and frequencies than were previously possible.

These, and other objects of the invention are realized by forming counterbores around the inner periphery of the waveguide flanges, as in the prior art. When waveguide sections are bolted together the counterbores form a circular groove that holds an annealed copper gasket, also as in the prior art. In the present invention, however, instead of steps with a rectangular cross section, the steps are beveled on the side that forms their outer circumference.

Advantageously, the particular shape of the steps in the present invention causes the copper gasket to conform in such a manner that the inner surface of the waveguide has no measurable gaps at all, and no sharp edges are exposed to the microwaves inside the waveguide. A reliable, arcfree vacuum seal is formed with the flange-gasket arrangement of the present invention.

DESCRIPTION OF THE PREFERRED EMBODIMENTS

Figure 1:
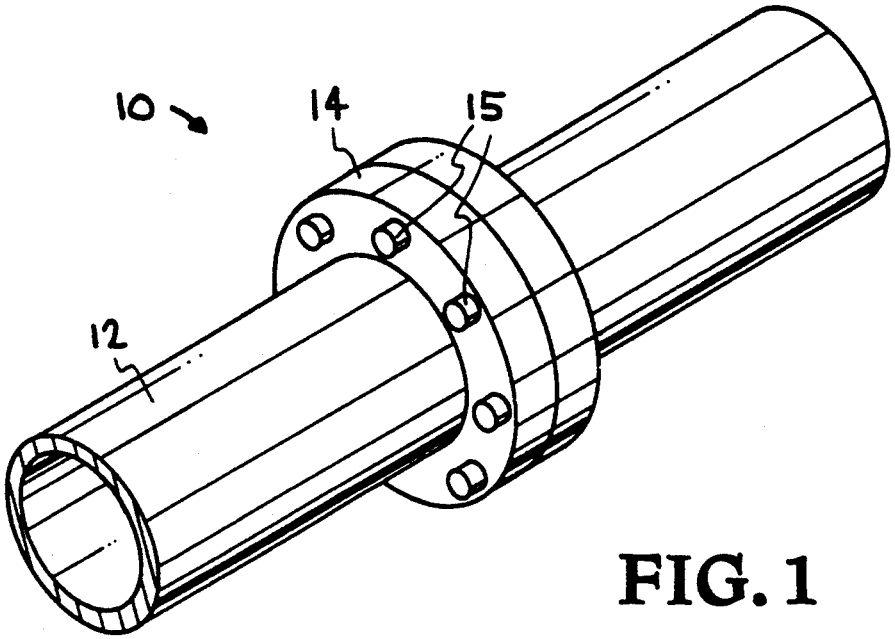
FIG. 1 shows a flange connection at the end of two waveguide sections.

A portion of a circular waveguide 10 showing the flange connection between two waveguide sections is shown in FIG. 1. Each waveguide section includes waveguide tube 12 and flange 14. The flanges from adjoining sections are connected with an array of bolts 15 around the outside of waveguide tube 12. All waveguide sections are made of copper tubing, with stainless steel flanges 14 brazed to tubes 12.

Figure 2:
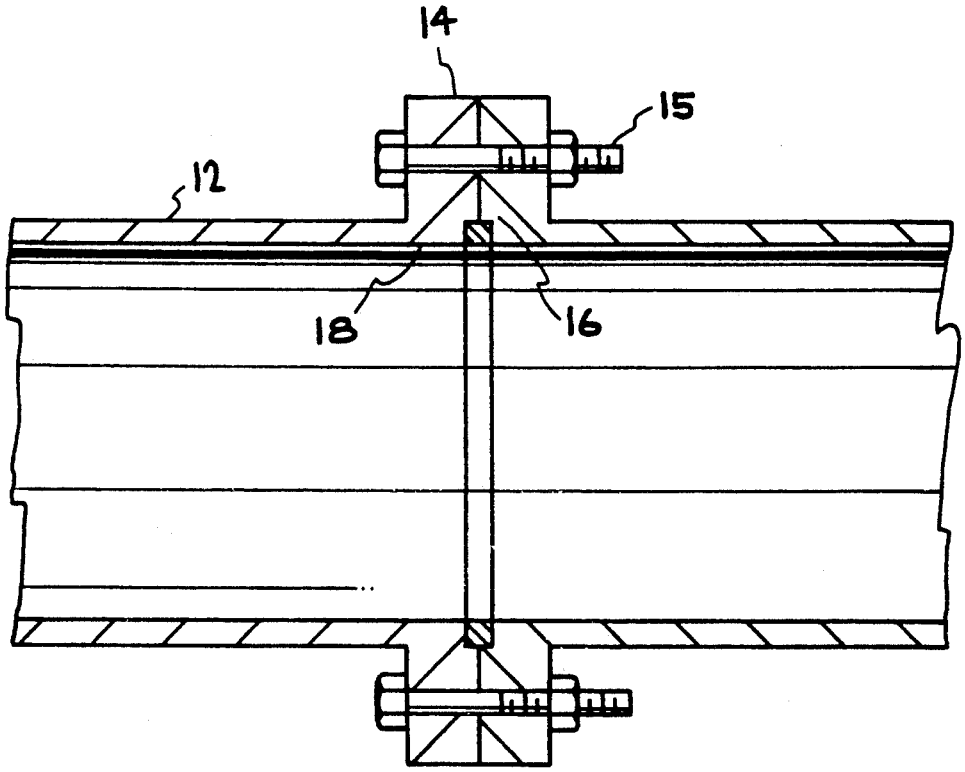
FIG. 2 shows a cross section of the waveguide across the flange connection of FIG. 1.

A cross section of a portion of waveguide 10 across flanges 14 is shown in FIG. 2. Region 16 across the junction between flanges 14 extends around the inner diameter of flanges 14 to include the junction between the flanges on the inner surface 18 of waveguide 10.

Figure 3A:
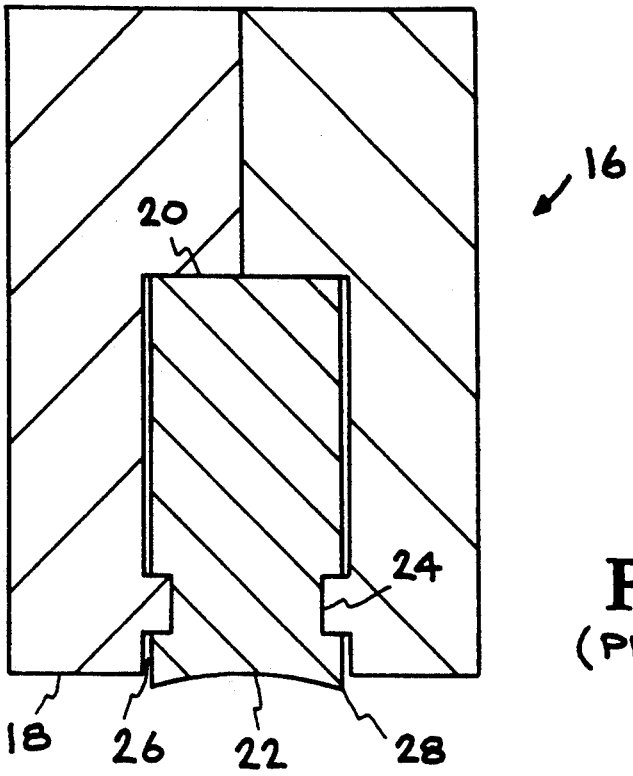
FIG. 3A (PRIOR ART)
FIGS. 3*a* and 3*b* show the prior art flange seal configuration and the flange seal configuration of the present invention, respectively.
Figure 3B:
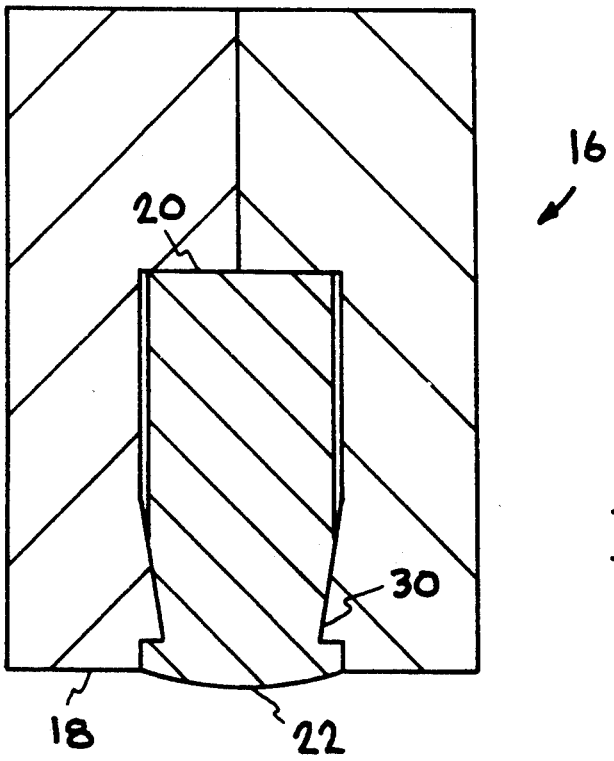

Region 16 has a groove formed by counterbores 20 in each flange 14 that contains a fully annealed copper gasket 22, as shown in FIGS. 3*a* and 3*b*. Gasket 22 is supposed to provide a vacuum seal and a smooth, continuous inner surface for waveguide 10.

The prior art flanges 14 have rectangular steps 24 formed on counterbores 20, as shown in FIG. 3*a*. Steps 24 are intended to insure gasket 22 provides a good vacuum seal. It was found that gaps 26 are formed between flange 14 and gasket 22 when rectangular steps 24 are employed. Additionally, exposed corners 28 protrude slightly, and are not flush with inner surface 18. The present inventors did not expect to find gaps 26, or corners 28 protruding past surface 18.

Although gaps 26 and corners 28 did not appear to cause arcing problems at the power and frequency levels used in the past, they are detrimental in the present day waveguide environment. It was found that gaps 26 were nominally about 0.004 inches, and that corners 28 extended about 0.005 inches beyond surface 18.

In accordance with the present invnetion, flanges 14 have steps 30 that are beveled at an angle of 15–25 degrees with respect to the surface of the counterbore 20 as shown in FIG. 3*b*. The shape of steps 30 on gasket 22 insures complete metal-to-metal contact—there were no measurable gaps between flanges 14 and gasket 22 along the waveguide wall. Also, no sharp corners are exposed. Thus, the beveled steps of the present invention provide for an improved waveguide surface that can sustain higher frequencies and power levels without arcing.

In a preferred embodiment in which waveguide 10 has a 3.5 inch inner diameter, counterbores 20 have a width of 0.06 inches on the side of steps 30 closet to surface 18, and a width of 0.068 inches on the far side of steps 30, side farthest from surface 18. Counterbores 20 extend to a depth or length of 0.209 inches into flanges 14 from surface 18. Copper gasket 22 is designed to fill counterbores 20 with an inner diameter of 3.5 inches and an outer diameter of 3.918 inches, and a thickness of 0.125 inches.

A novel feature of the present invention lies in the shape of steps 30, which are located 0.0385 inches from surface 18, and are 0.008 inches high on the side of the steps closest to surface 18. The bevel on steps 30 is 20 degrees. With this configuration steps 30 cause gasket 22 to form a smooth, central bump that extends 0.005 inches past surface 18, but does not have exposed sharp edges. Additionally, all of these dimensions are designed so that when adjoining flanges 14 are bolted together there is complete metal-to-metal contact between waveguide sections.

Flanges 14 with beveled steps 30 improve the quality of the inner surface 18 of waveguide 10 so it is able to effectively carry substantially more power at higher frequencies than was possible with the prior art waveguides. Arcing is prevented, and the waveguide power source is protected from damage.

Various other embodiments are also intended to be included within the scope of the invention. For instance, the shape of the beveled steps on the flanges may be varied to accommodate different gaskets. The invention may be used with rectangular waveguides. Different materials may be used, and so on. Indeed, the full scope of the invention is intended to be limited only by the following claims.

We claim:

1. A waveguide comprising at least one flange having a surface with a central opening and a counterbore extending around the periphery of said central opening, wherein;

said counterbore having extended first and second sections of predetermined length and different depth and including a step along a portion of its length interconnecting said first and second sections, said first section being contiguous with said central opening, and;

said step being beveled on the far side most removed from said central opening so that the height of said step changes gradually from its maximum height adjacent said first section of said counterbore to the height of said second section of said counterbore at said far side.

2. The waveguide of claim 1, wherein said step forms a right angle with said first section of said counterbore on the side closest to said central opening.

3. The waveguide of claim 1 further comprising an integral waveguide tube having the same cross section as said central opening, wherein;

said waveguide tube is aligned to said central opening.

4. The waveguide of claim 1 wherein said at least one flange comprises two flanges bolted together so the steps on their respective counterbores oppose each other.

5. The waveguide of claim 4, further comprising a gasket interposed between said opposing steps and defining a continuous surface between said two flanges.

6. The waveguide of claim 5 wherein said flanges are stainless steel and said gasket is fully annealed copper.

7. The waveguide of claim 1 wherein said beveled far side forms an angle between 15 and 25 degrees with respect to a surface of the counterbore.

8. The waveguide of claim 1 wherein said counterbore extends deeper into said flange at said far side of said step than at the side of said step closest to said central opening.

9. A waveguide having an improved vacuum and radio frequency seal between sections of the waveguide to enable the waveguide to be driven at higher powers and frequencies, said waveguide comprising:

a pair of waveguide sections, each section having a flange secured to one end thereof for interconnecting said sections;

each of said flanges having a central opening therein and a counterbore extending around a periphery of said central opening and having extended first and second sections of predetermined length and different depths;

said first section being contiguous with said central opening;

each of said counterbores including a beveled step therein located intermediate said first and second sections, said beveled step forming a substantially right angle with a surface of said first section of said counterbore on a side adjacent said central opening, said beveled step having a decreasing height extending in a direction away from said central opening to a surface of said second section of said counterbore;

a seal means positioned in said counterbores of said flanges and in contact with at least said first section of said counterbores; and means for securing said flanges together so as to compress said seal means there between for providing a continuous surface between said flanges.

10. The waveguide of claim 9, wherein said height of said beveled step decreases along an angle of 15–25 degrees with respect to the surface of the counterbore.

11. The waveguide of claim 9, wherein said second section of said counterbore extends deeper into said flange at a farthest side of said beveled step from said central opening compared to a side of said beveled step on said first section of said counterbore and closest to said central opening.

12. The waveguide of claim 9, wherein said flanges are composed of stainless steel and said seal means is composed of annealed copper.

13. The waveguide of claim 9, wherein said central openings and said counterbores in said flanges have a circular configuration.

* * * * *